US006309124B1

(12) United States Patent
Gueret

(10) Patent No.: US 6,309,124 B1
(45) Date of Patent: Oct. 30, 2001

(54) DEVICE FOR DISPENSING AND APPLYING A PRODUCT

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/482,685

(22) Filed: Jan. 14, 2000

(30) Foreign Application Priority Data

Jan. 15, 1999 (FR) ..... 99 00407

(51) Int. Cl.[7] ..... A46B 11/00
(52) U.S. Cl. ..... 401/124; 401/123; 401/125
(58) Field of Search ..... 401/119, 123–127, 401/130, 146, 170, 187–189, 202, 262; 222/205, 321.9, 321.7

(56) References Cited

U.S. PATENT DOCUMENTS

| | | | | |
|---|---|---|---|---|
| 2,554,489 | * | 5/1951 | Crane | 401/125 |
| 2,767,417 | | 10/1956 | Amen . | |
| 3,871,390 | * | 3/1975 | Spatz | 401/123 |
| 4,089,609 | * | 5/1978 | Gring et al. | 401/130 |
| 4,795,063 | | 1/1989 | Sekiguchi et al. . | |
| 5,052,592 | * | 10/1991 | Wilken et al. | 222/212 |
| 5,178,300 | * | 1/1993 | Haviv et al. | 222/105 |
| 5,692,846 | * | 12/1997 | Schwarzberg | 401/190 |
| 5,890,828 | | 4/1999 | Gueret . | |
| 5,945,076 | * | 8/1999 | Leonard et al. | 401/123 |

FOREIGN PATENT DOCUMENTS

| | | |
|---|---|---|
| 406 544 | 8/1966 | (CH) . |
| 39 38 347 | 5/1991 | (DE) . |
| 0 380 183 | 8/1990 | (EP) . |
| 0 743 263 | 11/1996 | (EP) . |
| 2 750 406 | 1/1998 | (FR) . |
| 2 754 458 | 4/1998 | (FR) . |

OTHER PUBLICATIONS

English Translation of CH 406 544.
English language Derwent Abstract of DE 39 38 347.
English language Derwent Abstract of EP 0 743 263.
English language Derwent Abstract of FR 2 750 406.

* cited by examiner

*Primary Examiner*—Gregory L. Huson
*Assistant Examiner*—Tuan Nguyen
(74) *Attorney, Agent, or Firm*—Finnegan, Henderson, Farabow, Garrett, Dunner, L.L.P.

(57) ABSTRACT

A device for dispensing and applying a product includes a container including a reservoir for containing a product, and a dispensing member for dispensing the product. The dispensing member includes an actuating element and at least one outlet. The actuating element is configured to be actuated to enable delivery of the product through the at least one outlet. The device further includes a cap configured to fit removably on the container. The cap comprises an applicator preferably including porous material. The applicator is substantially sealed from outside of the device when the cap is on the container. Placement of the cap on the container positions the applicator with respect to the at least one outlet so that at least a portion of the applicator is placed in contact with the product delivered through the at least one outlet when the actuating element is actuated. Preferably, the product at least partially impregnates the applicator when the product contacts the applicator.

29 Claims, 5 Drawing Sheets

DEVICE FOR DISPENSING AND APPLYING A PRODUCT

The present invention relates to a device for dispensing and applying a product, for example, a cosmetic product. The invention is preferably used to dispense and apply products in the form of liquid, gel, and/or cream. For example, the device can be used to dispense and apply products, such as skin-care and hair-care products, make-up removers, and hair-coloring products.

In the field of cosmetics, products such as milks, creams and gels, are preferably dispensed under pressure with a pump. Because of their instability in the presence of air, however, such products are preferably packaged in pump systems with no air intake (i.e., airless pumps). In other words, the products are packaged under vacuum in reservoirs, wherein the volume of the reservoir decreases as the product is used. Typically, the reservoir is a bag with retracting walls, a tube with deformable walls, or a bottle including a follower piston. Examples of suitable pumps include piston, diaphragm, and shutter type pumps.

To apply the product from a conventional dispensing system, the user dispenses the product from the reservoir onto her fingers and rubs it into the surface that is to be treated. Alternatively, the product is applied using an applicator, such as a foam applicator.

In systems having applicators that are designed to be reusable, it may be desirable for the applicator to be stored away from air between uses so that its mechanical properties (e.g, flexibility and/or absorptivity) are not adversely affected by air reacting with product residue remaining on the applicator. In particular, in tie case of an applicator that is not cleaned after each use, product remaining on the applicator may react with the ambient air and/or other elements in the environment in which the applicator is kept. Additionally, residue remaining on the applicator may soil the applicator, thereby adversely affecting the product during the next use.

In the case of certain applicators, such as applicators shaped like the profile of the surface that is to be treated (e.g., the lips and/or the corner of the eye), it may be desirable for the product to be deposited on the applicator in the same way and in the same quantity so that the product can be consistently applied during each application.

In light of the foregoing, there is a need in the art for an improved device for dispensing an applying a product.

Accordingly, the present invention is directed to a device and product application method that preferably obviate one or more of the short-comings of the related art.

A preferred object of the invention is to provide a device that allows the applicator to be kept substantially sealed from the external environment.

Another preferred object of the invention is to provide a device including an applicator that is easy to transport and to handle.

A further preferred object of the invention is to provide a device for dispensing and applying a product, wherein the loading of the applicator with product is reproducible.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a device for dispensing and applying a product. The device includes a container including a reservoir for containing a product, and a dispensing member for dispensing the product. The dispensing member includes an actuating element and at least one outlet. The actuating element is configured to be actuated to enable delivery of the product through the at least one outlet. The device further includes a cap configured to fit removably on the container. The cap comprises an applicator preferably including porous material. The applicator is substantially sealed from outside of the device when the cap is on the container. Placement of the cap on the container positions the applicator with respect to the at least one outlet so that at least a portion of the applicator is placed in contact with the product delivered through the at least one outlet when the actuating element is actuated. Preferably, the product at least partially impregnates the applicator when the product contacts the applicator.

The applicator is preferably substantially sealed inside a region at least partially defined by the cap. The applicator occupies either a portion of the region or all of the region.

Preferably, when stored between applications, the applicator is kept substantially sealed from the external environment. The cap facilitates easy handling of the applicator, and allows the product to be applied under good conditions, without dirtying the fingers. When the cap is on the container, the applicator is positioned with respect to the outlet(s) so that the product contacts the applicator when the actuating element is actuated. Preferably, the applicator includes porous material and the product at least partially impregnates the applicator when the actuating element is actuated. The outlet(s) is/are preferably positioned with respect to the applicator so that applicator is always loaded in substantially same way (i.e., at substantially the same points with substantially identical quantities). The application performed is thus reproducible.

Dispensing of the product may take place when the cap is on the container so that the applicator is substantially sealed from outside of the device, or when the applicator is only partially sealed from the outside of the device. For example, before actuating the dispensing member, a user may remove the cap slightly, thereby creating a small air leak in order to avoid overpressure within the region containing the applicator. Although the dispensing member is preferably actuated prior to each new use when the cap is on the container, one of ordinary skill in the art would recognized that the dispensing member could also be actuated when the cap is separate from the container. In other words, the applicator can be reloaded with product without replacing the cap back on the container.

Preferably, the dispensing member includes a pump. More preferably, the dispensing member includes an airless pump (i.e., a pump without an air intake opening). In the embodiment having an airless pump, the volume of the reservoir decreases by an amount that substantially corresponds to the volume of the dispensed product. Airless pumps are particularly suited to the dispensing of products whose properties may be adversely affected by contact with air and other environmental contaminates, and they do not require the use of a dip tube. In an alternate embodiment, however, the dispensing member includes a pump having an air intake and/or a dip tube.

In the embodiment having an airless pump, the reservoir preferably includes a flexible bag with retractable walls, a flexible tube, a bottle with a deformable diaphragm, such as an elastically deformable diaphragm, or a bottle with a follower piston. Because the volume of the reservoir decreases by an amount substantially equal to the volume of the dispensed product, the remaining product occupies substantially the entire available volume of the reservoir throughout the life of the device.

European Patent Application No. EP-A-0,743,263 discloses an example of a device having an elastically deformable diaphragm. More specifically, the disclosed device includes an elastic diaphragm that forms the base of a rigid container on which a pump and a push-button are mounted. The diaphragm is fixed at its periphery to the wall of the rigid container and is initially flat in shape. In the alternative, the diaphragm is slightly concave or convex curved towards the product. As the device is used, the diaphragm is able to gradually deform elastically over an axial distance of 15 to 20 mm, for example, so as to hug the inside of the container. A design of this kind, through its shape, makes it possible to give the applicator greater surface area, thereby making it possible to produce an applicator for larger areas of the body, such as the bust or thighs.

The dispensing member preferably includes a pump including a shutter, a diaphragm, or a piston. Such pumps are well known in the art and therefore require no additional description.

The applicator preferably includes an open-cell and/or semi-open-cell foam or a frit. As used herein, frit refers to sintered or fused material. Such materials advantageously dispense the product to the surface to be treated by a capillary and/or surface-tension effect upon contact with the surface, and/or by the product being expelled from the cells (i.e., pores) of the applicator in response to a slight deformation (e.g., from pressing) of the applicator when the applicator is brought into contact with the surface to be treated. The applicator may include several different materials, for example, the applicator may be formed of foams with different hardnesses. In one embodiment, the applicator includes some open-cell foam and some closed-cell foam.

The applicator preferable includes one or more of polyether foam, polyester foam, polyurethane foam, NBR (natural butadiene rubber) foam, SBR (synthetic butadiene rubber) foam, PVC (polyvinyl chloride) foam, bronze frit, polyethylene frit, glass frit, silicone frit, and nylon frit.

In one embodiment, the actuating element is actuated by applying force to the cap when the cap is on the container. In an alternate embodiment, the container includes a rigid or semi-rigid base, and the actuating element is actuated by applying force to the base.

In another embodiment, the container further includes an outer housing coupled to the reservoir. The outer housing preferably includes a receiving surface configured to receive the applicator when the cap is on the container. The outlet(s) preferably includes an opening in the receiving surface. The receiving surface preferably has a shape substantially the same as the outer surface of the applicator and at least a portion of the applicator rests on the receiving surface when the cap is on the container.

Preferably, the receiving surface includes at least one of grooves, channels, and ducts that direct the product along the receiving surface when the product is dispensed through the at least one outlet. The grooves, channels and/or ducts preferably facilitate capillary action of the product to allow better loading of the applicator over a wider area, extending far beyond the immediate vicinity of the outlets(s). The applicator may occupy substantially the entire volume of the region defined by the receiving surface and the cap, or just part of the volume. Preferably, the applicator occupies a part of the volume, which advantageously reduces problems associated with piston suction effects. The receiving surface is preferably hemispherically cup-shaped.

In still another embodiment, the container further includes an inner housing that includes the reservoir and an outer housing coupled to the inner housing. In this embodiment, the base is formed by a portion of the inner housing.

In one embodiment, the reservoir is preferably within a rigid or semi-rigid bottle that includes a follower piston mounted to slide. For example, the reservoir is defined by a portion of the interior of the inner housing and the follower piston. Alternatively, the reservoir is a bag with flexible walls, such as a bag including paper and/or aluminium and/or plastic materials. The bag is preferably placed inside a semi-rigid to rigid housing, such as a housing made of polypropylene and/or polyethylene.

In yet another embodiment, the dispensing member includes structure for limiting the actuating stroke of the pump, so that the volume of the dispensed dose can be varied at will.

The cap is preferably removably attachable to the container by at least one of snap-fastening and screw-fastening. More preferably, the cap is removably attachable to the container by screw-fastening, which provides a better seal than other conventional methods. At least one of the cap and the container preferably includes a seal (e.g., rubber or plastic seal) and/or sealing lip to improve the seal between the cap and the container and thereby ensure that the applicator is out of contact with outside air when the cap is fitted on the container.

In a preferred embodiment, the reservoir of the device contains a cosmetic product and/or a pharmaceutical product in the form of a liquid, a gel, or a cream.

In another aspect, the invention includes a method of applying a product to the body. The method includes providing one of the devices for dispensing and applying a product described above, wherein the device includes at least one of a cosmetic and pharmaceutical product in the reservoir. The product is dispensed by actuating the actuating element when the cap is on the container so that the product contacts at least a portion of the applicator. In a preferred embodiment, the container includes an outer housing coupled to the reservoir, and the actuating element is actuated by applying force to the outer housing and/or the reservoir and/or the cap. In another embodiment, the applicator includes porous material and the applicator is at least partially impregnated with product when the actuating element is actuated with the cap on the container. The cap is then removed from the container, and the product is applied by contacting the applicator to the body.

Besides the structural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a cross-sectional view of a first embodiment of a device for dispensing and applying a product;

Figure 1:
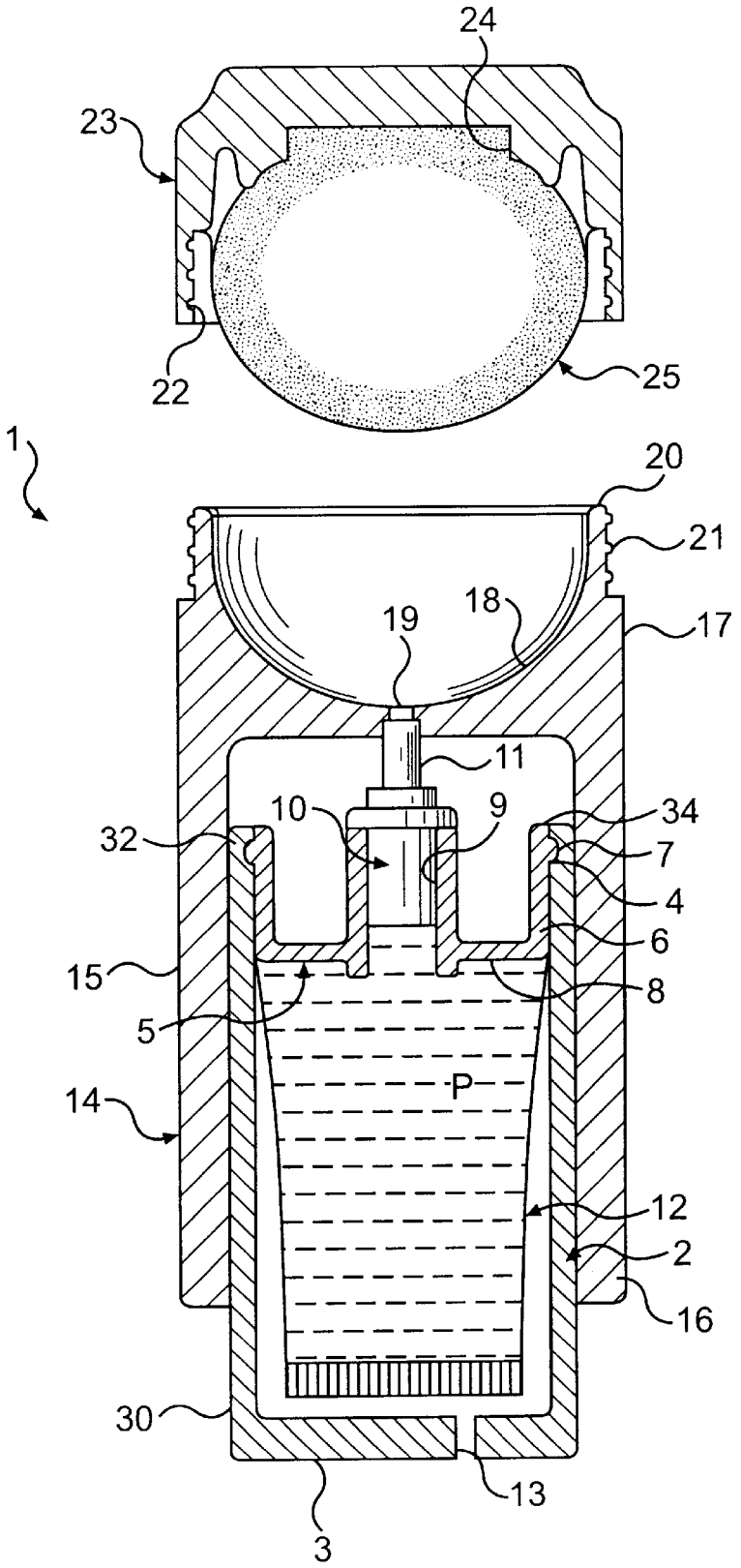

Reference will now be made in detail to the present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

Referring to FIG. 1, a device 1 for dispensing and applying a product comprises a container 14, a dispensing member 10, and a cap 23. The container 14 includes a reservoir 12, an inner housing 2, and an outer housing 15. The inner housing 2 is preferably a rigid, cylindrical body that is made of polypropylene. The cross-section of the inner housing 2 is preferably circular, oval, elliptical, or any other desired shape. An end 30 of the inner housing 2 includes a rigid base 3. A groove 4 is provided on an interior surface of the inner housing 2 adjacent to an open end 32, for receiving a mounting structure 5. The mounting structure 5 is preferably coupled to the inner housing 2 by snap-fastening and includes a lateral skirt 6. An exterior surface of the skirt 6 adjacent an upper edge 34 of the skirt 6 has a bead 7 configured to snap-fasten with the groove 4 of the inner housing 2. The mounting structure 5 also includes a transverse flange 8 extending from an end of the skirt 6 opposite to the upper edge 34. The flange 8 is preferably substantially perpendicular to the skirt 6. An axial portion 9 of the mounting structure 5 extends from the flange 8. The axial portion 9 preferably has a cylindrical cross section.

The dispensing member 10 of the device 1 is coupled to the axial portion 9. The dispensing member 10 includes an actuating element 11. For example, in the embodiment of FIG. 1, the dispensing member 10 is an airless pump and the actuating element 11 is a pump stem.

Figure 7:
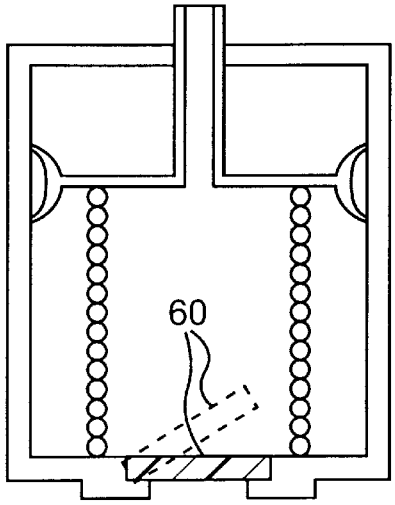
FIG. 7 is a partial schematic view of a pump with a closure member.

FIG. 7 is a schematic view of a pump including a closure member 60 that could be included in the dispensing member of the present invention. For example, the closure member 60 could be a shutter or a diaphragm. The broken lines in FIG. 7 show an embodiment of a shutter in the open position. Alternatively, the closure member 60 could be a diaphragm substantially sealed at the periphery with a slit in a middle portion.

The dispensing member 10 is preferably force-fitted, snap-fastened, and/or screw-fastened inside the axial portion 9, thereby sealing the dispensing member to the axial portion 9. Thus, the dispensing member 10 is secured to the mounting structure 5, which also bears the weight of the reservoir 12.

The reservoir 12 is preferably coupled to the mounting structure 5 by bonding, snap-fastening, and/or welding, and is positioned on an exterior surface of the skirt 6 so that an open end of the reservoir 12 is adjacent to the dispensing member 10. In a preferred embodiment, the reservoir 12 is a flexible tube or a flexible-walled bag made of an aluminium-based complex, containing a product P. The reservoir 12 is secured in the container 14 by the rigid inner housing 2 which, in combination with the skirt 6 of the mounting structure 5, sandwiches the open end of the reservoir 12.

The base 3 preferably includes an opening 13 for allowing air to be taken into the inner housing 2 to compensate for the reduction in volume of the reservoir 12 during use (i.e., to equalize pressure). Alternatively, air intake is achieved by a flap valve arranged in the base 3 of the inner housing 2.

The outer housing 15 of the container 14 is coupled to the actuating element 11 and is axially movable (slidable) with respect to the inner housing 2. The outer housing 15 is preferably cylindrical, and forms a skirt. An end 16 of the outer housing 15 distal from the actuating element 11 is open to outside of the container 14. The open end 16 is proximal to the rigid base 3 of the inner housing 2. When the actuating element 11 is in the rest position (i.e., not being actuated), the inner housing 2 preferably emerges from the end 16 by a distance corresponding at least to the actuating stroke of the dispensing member 1. The outer housing 15 has an inside diameter slightly greater than the outside diameter of the inner housing 2, thereby allowing the outer housing 15 to slide freely with respect to the inner housing 2 when the actuating element 11 is actuated.

The cap 23 of the device 1 includes an interior skirt 24 and an applicator 25 on the skirt 24. The applicator 25 is preferably a block of open-cell compressible foam fixed to the skirt 24 by bonding or welding. In a preferred embodiment, the applicator 25 is substantially ovoid or spherical in shape.

Opposite to the open end 16, the outer housing 15 includes an upper portion 17 having a receiving surface 18 configured to receive the applicator 25. The receiving surface 18 is preferably shaped like a hemispherical cup and includes at least one outlet 19, which allows fluid communication between the dispensing member 10 and the receiving surface 18. In the embodiment of FIG. 1, the outlet 19 is shown at the center of the receiving surface 19, with the actuating element 11 being in fluid communication with the surface 18. Adjacent to the surface 18, the outlet 19 has a cross-section that is slightly smaller than the outside diameter of the actuating element 11 so that the actuating element 11 abuts the smaller cross-section of the outlet 19 when the actuating element 11 is actuated. This configuration facilitates controlling the amount of product dispensed each time the actuating element 11 is actuated. The outer housing 15 of the container 14 allows the user to maintain a good grip on the device 1 for removing the cap 23 from the container 14 and for replacing the cap 23 on the container 14.

The receiving surface 18 includes a free edge 20 at an end of the receiving surface 18 distal from the outlet 19. The exterior surface of the free edge 20 preferably includes a screw thread 21 configured to couple with a corresponding screw thread 22 of the cap 23.

The cap 23 and receiving surface 18 are preferably configured so that when the cap 23 is on the container 14, the applicator 25 is adjacent to the receiving surface 18 and the outlet 19. In one embodiment, the applicator 25 is compressed against the receiving surface 18 when the cap 23 is on the container 14.

Figure 5:
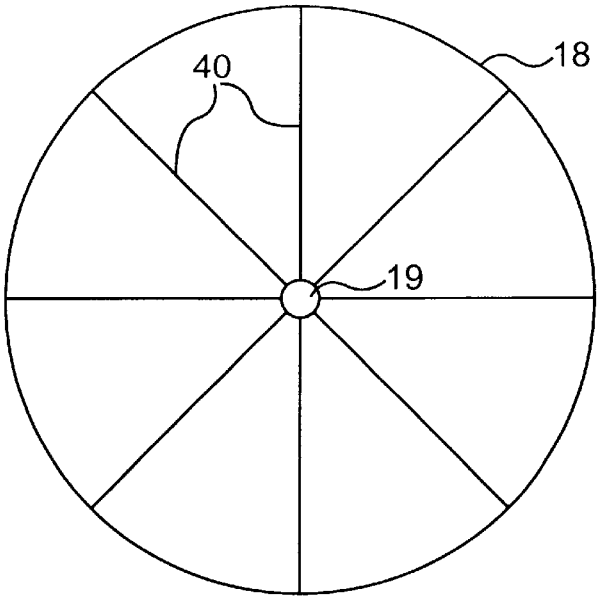
FIG. 5 is a view of an embodiment of receiving surface for the devices of FIGS. 1–4.

The receiving surface 18 may be smooth or may have reliefs, such as radial striations, grooves, channels, and/or ducts 40 (FIG. 5), which allow the product to be directed to points further from the outlet 19 than when the receiving surface 18 is smooth.

Figure 2C:
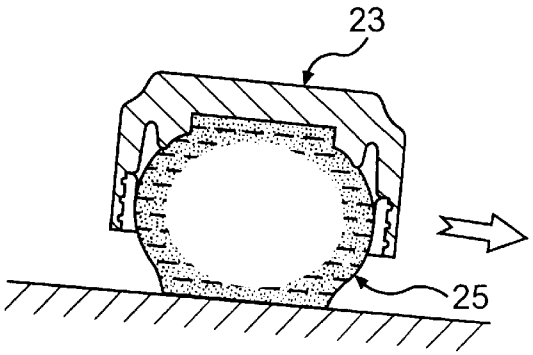
FIGS. 2A–2C are views showing a method of using the device of FIG. 1 to dispense and apply a product.
Figure 2B:
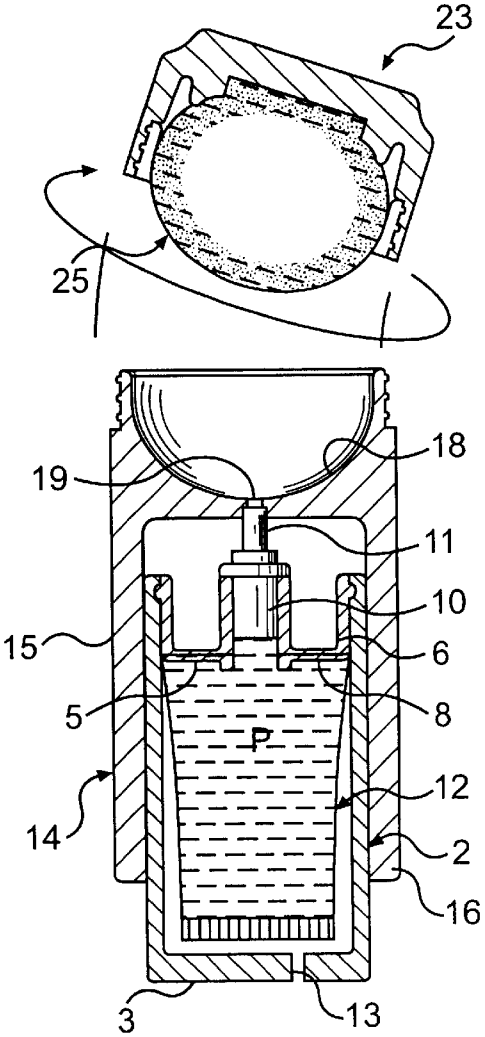
Figure 2A:
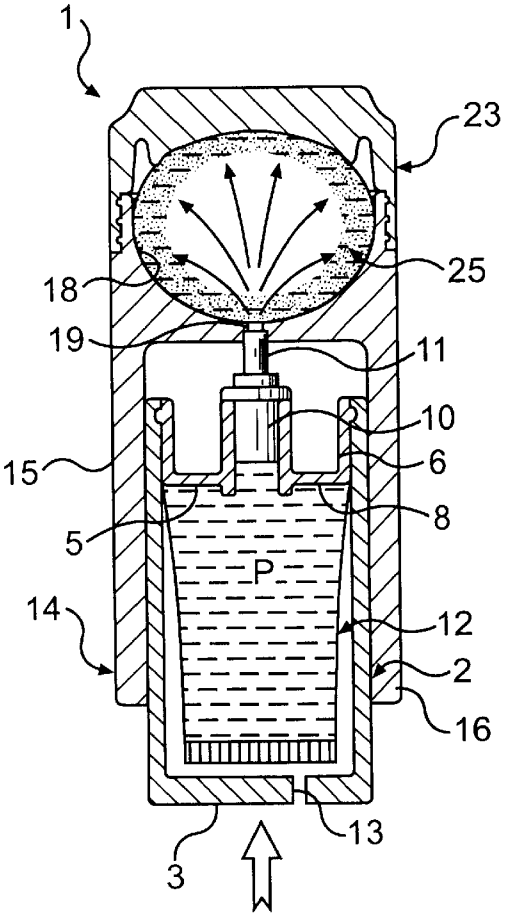

Referring to FIGS. 2A–2C, to use the device 1, the user actuates the actuating element 11 by applying force to the outer housing 15 and/or the base 3 of the inner housing 2, with the cap 23 on the container 14. For example, the user firmly grips the outer housing 15 and presses the base 3 against a surface. (FIG. 2A.) When fully actuated, the actuating element 11 is pushed into abutment with the smaller cross-section portion of the outlet 19. In this position, the actuating element 11 is depressed and a dose of product P contained in the reservoir 12 is delivered. The product P leaves the reservoir 12 via the actuating element 11 and the outlet 19, and is dispensed onto the receiving surface 18. The dispensed product then comes into contact with the applicator 25. The product is transported along the receiving surface 18 partly by capillary action and/or by pressure.

As shown in FIG. 2B, the user then unscrews the cap 23 to remove the applicator 25 from the container 14. In one embodiment, the applicator 25 is a block of foam that is slightly compressed when the cap 23 is on the container 14. For this embodiment, the block of foam expands upon removal of the cap 23 from the container 14, thereby facilitating the pumping out of some of the product that might not have been absorbed when the cap 23 was closed. This expansion of the applicator 25 also makes it possible for at least a portion of the applicator 25 to be placed back in contact with the receiving surface 18 for loading and/or reloading of the product onto the applicator 25 when the cap 23 is not on the container 14. To load the product, the applicator 25 is placed in contact with the receiving surface 18 and the actuating element is actuated by moving the outer housing 15 toward the base 3.

FIG. 2C shows how the user transfers the product from the applicator 25 to the surface to be treated. The user preferably exerts slight pressure on the applicator 25 to expel the product from the pores of the applicator 25, thereby transferring it to the surface to be treated. Before being repositioned on the reservoir, the applicator 25 may be washed in a cleaning solution (e.g., under tap water) to clean it.

Figure 3:
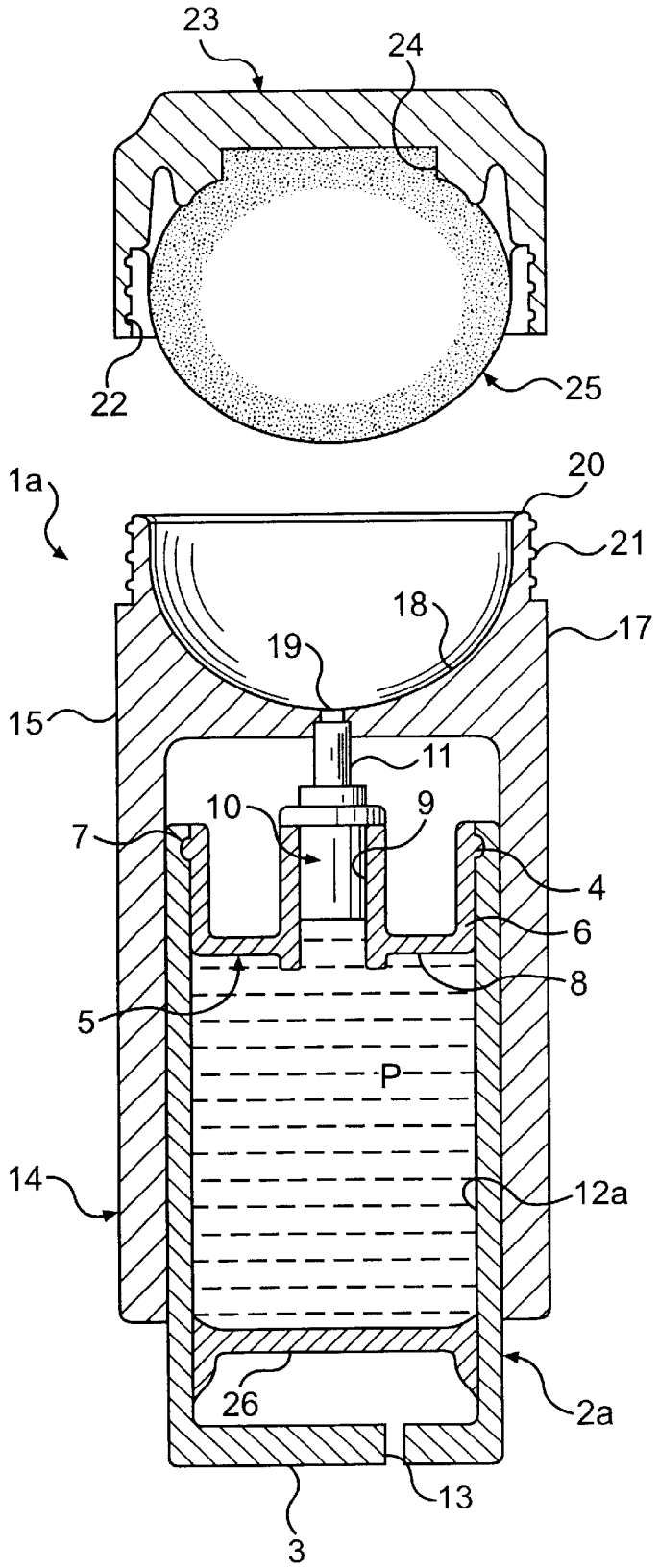
FIG. 3 is a cross-sectional view of a second embodiment of a device for dispensing and applying a product.
Figure 6:
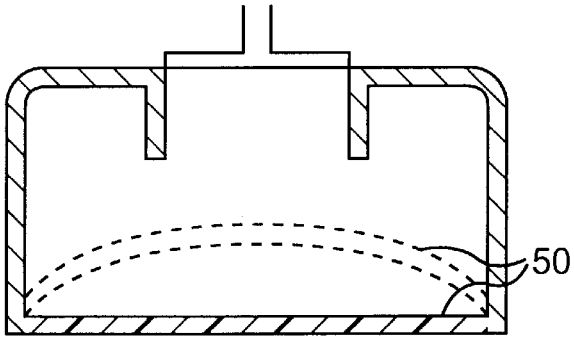
FIG. 6 is a partial schematic view of a reservoir with a deformable diaphragm.

FIG. 3 shows a second embodiment of a device 1*a*. The embodiment of FIG. 3 differs from the embodiment of FIG. 1 in that the reservoir 12*a* is defined by a portion of the interior of the rigid inner housing 2*a* and a follower piston 26. The follower piston 26 slides axially in a sealed manner within the inner housing 2*a*. The portion of the inner housing 2*a* between the follower piston 26 and the base 3 is at atmospheric pressure via the opening 13. The device la functions in a manner similar to the device 1, described above. In particular, the actuating element 11 is actuated by applying force to the outer housing 15 and/or the base 3, while firmly holding the container 14. As the product is dispensed, the piston 26 rises up inside the inner housing 2*a*, thereby decreasing the volume of the reservoir 12*a*. Alternatively, as shown schematically in FIG. 6, the reservoir is defined by a portion of the inner housing and an elastic diaphragm 50, which expands (shown with broken lines) in the inner housing as the product is dispensed.

In another embodiment similar to the embodiment of FIG. 3 (not shown), the mounting structure 5 includes a second skirt that extends in a direction opposite from the skirt 6, wherein the reservoir is defined by the second skirt of the mounting structure 5 and a portion of a follower piston. The outer housing 15, which includes the receiving surface 18 is mounted on the actuating element 11, and has an exterior skirt which slides inside the skirt 6 as the actuating element 11 is actuated, The cap 23 is preferably screwed onto a free edge of the outer housing 15 and the actuating element 11 is actuated by depressing the cap 23 with respect to the mounting structure 5.

Figure 4:
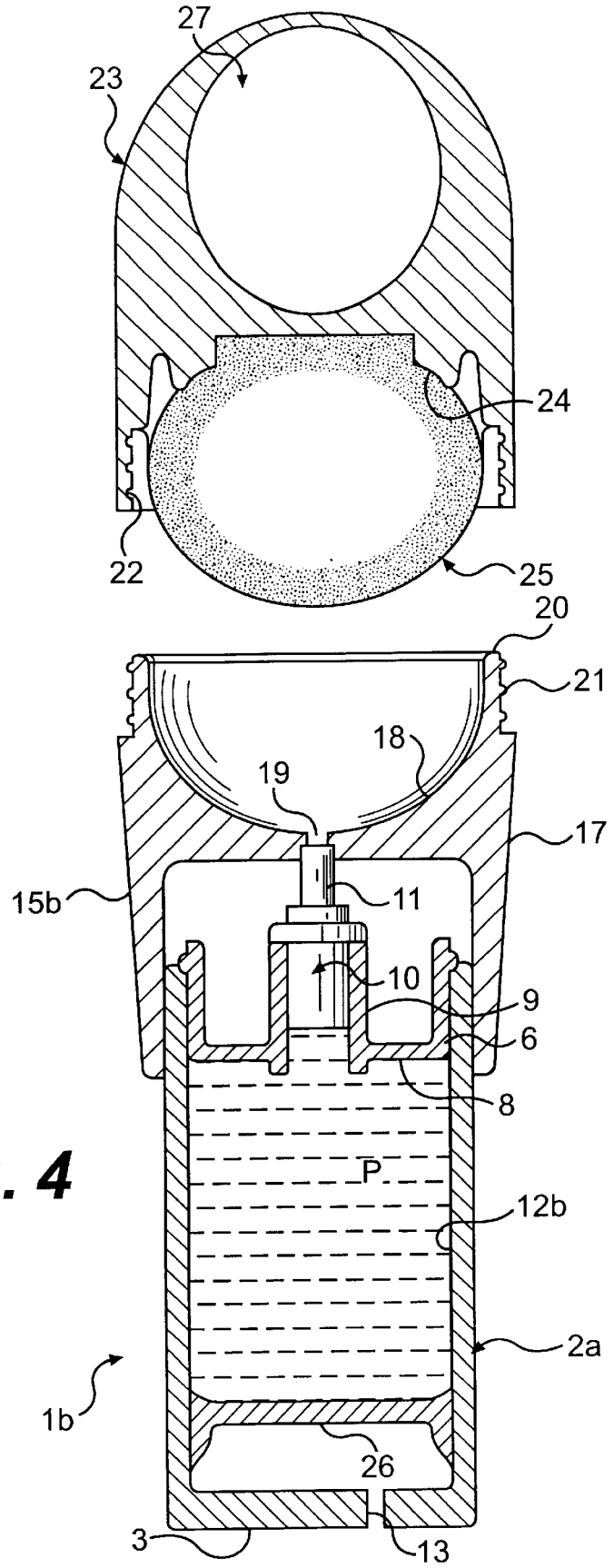
FIG. 4 is a cross-sectional view of a third embodiment of a device for dispensing and applying a product.

FIG. 4 shows yet another embodiment of a device 1*b*. The embodiment of FIG. 4 differs from the embodiment of FIG. 3 in that actuation of the actuating element 11 is performed by applying force to the cap 23, which causes the outer housing 15*b* to move downward until the receiving surface 18 comes into contact with the upper end of the actuating element 11. A hole 27 is formed in the cap 23 so as to allow the user to hook a finger through it. This feature makes the cap 23 easier to hold and manipulate during application. In this embodiment, the reservoir is defined by the inner housing 2*a* and the follower piston 26, as in the device 1*a* of FIG. 3. The outer housing 15*b* extends over a short axial portion of the inner housing 2*a*. When the actuating element 11 is actuated, the product flows from the reservoir 12*b* to the receiving surface 18 via the outlet 19. The product is then transferred onto the applicator member 25 by capillary and/or pumping action. The product is then applied in the same way as in the previous embodiments.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A device for dispensing and applying a product, the device comprising:

a container including a reservoir for containing a product;

a dispensing member for dispensing the product, the dispensing member including an actuating element and at least one outlet, the actuating element being configured to be actuated to enable delivery of the product through the at least one outlet; and a cap configured to fit removably on the container, the cap comprising an applicator including porous material, the porous material being capable of absorbing the product and being substantially sealed from outside of the device when the cap is on the container, placement of the cap on the container positioning the applicator with respect to the at least one outlet so that at least a portion of the applicator is placed in contact with the product delivered through the at least one outlet when the actuating element is actuated.

2. The device of claim 1, wherein the dispensing member includes a pump for pumping the product through the at least one outlet when the actuating element is actuated.

3. The device of claim 1, wherein the dispensing member includes an airless pump, and wherein the volume of the reservoir decreases when the product is dispensed.

4. The device of claim 3, wherein the volume of the reservoir decreases in an amount substantially equal to the volume of the product dispensed.

5. The device of claim 3, wherein the reservoir is one of a flexible bag, a flexible tube, a bottle with a deformable diaphragm, and a bottle having a follower piston.

6. The device of claim 5, wherein the reservoir includes the bottle with the deformable diaphragm, and wherein the diaphragm is elastically deformable.

7. The device of claim 1, wherein the dispensing member includes a pump having at least one of a shutter, a diaphragm, and a piston.

8. The device of claim 1, wherein the porous material includes at least one block of at least one of open-cell foam, semi-open-cell foam, and frit.

9. The device of claim 8, wherein the applicator includes at least one of polyether foam, polyester foam, polyurethane foam, natural butadiene rubber foam, synthetic butadiene rubber foam, polyvinyl chloride foam, bronze frit, polyethylene frit, glass frit, silicone frit, and nylon frit.

10. The device of claim 1, wherein the actuating element is configured to be actuated by applying force to the cap when the cap is on the reservoir.

11. The device of claim 1, wherein the container includes one of a rigid and semi-rigid base, and wherein the actuating element is actuated by applying force to said base.

12. The device of claim 11, wherein the reservoir is defined by a portion of the interior of the container.

13. The device of claim 1, wherein the cap is removably attachable to the container by at least one of snap-fastening and screw-fastening.

14. The device of claim 1, wherein the container further includes an outer housing coupled to the reservoir.

15. The device of claim 14, wherein the outer housing includes a receiving surface configured to receive the applicator when the cap is on the container, the at least one outlet including an opening in said receiving surface.

16. The device of claim 15, wherein said receiving surface has a shape substantially the same as an outer surface of the applicator.

17. The device of 16, wherein at least a portion of the applicator rests on said receiving surface when the cap is on the container.

18. The device of claim 17, wherein the receiving surface includes at least one of radial striations, grooves, channels, and ducts configured to direct the product along said receiving surface when the product is dispensed through the at least one outlet.

19. The device of claim 15, wherein a volume of the applicator is less than a volume of a region defined by the cap and said receiving surface when the cap is on the container.

20. The device of claim 15, wherein said receiving surface is cup-shaped.

21. The device of claim 15, wherein said receiving surface is hemispherical shaped.

22. The device of claim 14, wherein the container further includes an inner housing coupled to the outer housing, the inner housing including the reservoir.

23. The device of claim 22, wherein the at least one outlet includes an opening in an outer surface of the outer housing.

24. The device of claim 1, further comprising at least one of a cosmetic product and a pharmaceutical product in the reservoir.

25. A method of applying a product to the body, the method comprising:

providing the device of claim 1 including at least one of a cosmetic product and a pharmaceutical product in the reservoir;

dispensing the product by actuating the actuating element when the cap is on the container so that the applicator is at least partially impregnated with the product;

removing the cap from the container; and applying the product by placing the applicator in contact with the body.

26. A device for dispensing and applying a product, the device comprising:

a container including a reservoir for containing a product and an outer housing coupled to the reservoir;

a dispensing member for dispensing the product, the dispensing member including an actuating element and at least one outlet, the actuating element being configured to be actuated by applying force to one of the outer housing and the reservoir, the actuation of the actuating element enabling delivery of the product through the at least one outlet; and a cap configured to fit removably on the container, the cap comprising an applicator substantially sealed from outside of the device when the cap is on the container, placement of the cap on the container positioning the applicator adjacent to the outer housing and the at least one outlet so that at least a portion of the applicator contacts the product dispensed through the at least one outlet when the actuating element is actuated.

27. A method of applying a product to the body, the method comprising:

providing the device of claim 26 including at least one of a cosmetic product and a pharmaceutical product in the reservoir;

dispensing the product by applying force to at least one of the outer housing and the reservoir when the cap is on the container so that the product contacts at least a portion of the applicator;

removing the cap from the container; and applying the product by placing the applicator in contact with the body.

28. A device for dispensing and applying a product, the device comprising:

a container including a reservoir containing at least one of a cosmetic product and a pharmaceutical product;

a dispensing member for dispensing the product, the dispensing member including an actuating element and at least one outlet, the actuating element being configured to be actuated to enable delivery of the product through the at least one outlet; and a cap configured to fit removably on the container, the cap comprising an applicator substantially sealed from outside of the device when the cap is on the container, placement of the cap on the container positioning the applicator with respect to the at least one outlet so that at least a portion of the applicator is placed in contact with the product delivered through the at least one outlet when the actuating element is actuated.

29. A method of applying a product to the body, the method comprising:

providing the device of claim 28;

dispensing the product by actuating the actuating element when the cap is on the container so that the product contacts at least a portion of the applicator;

removing the cap from the container; and applying the product by placing the applicator in contact with the body.

* * * * *